US007310068B2

(12) United States Patent
Hu et al.

(10) Patent No.: US 7,310,068 B2
(45) Date of Patent: Dec. 18, 2007

(54) CHIP ANTENNA MOUNTING APPARATUS

(75) Inventors: Chuan-Lin Hu, Sijhih (TW); Yu-Wei Chen, Sijhih (TW); Chang-Lun Liao, Sijhih (TW); Shun-Tian Lin, Taipei (TW); Chang-Fa Yang, Taipei (TW); Yen-Ming Chen, Taipei (TW); Chao-Wei Wang, Taipei (TW)

(73) Assignee: Chant Sincere Co., Ltd., Hsi Chih, Taipei Hsien (TW)

( * ) Notice: Subject to any disclaimer, the term of this patent is extended or adjusted under 35 U.S.C. 154(b) by 0 days.

(21) Appl. No.: 11/564,033

(22) Filed: Nov. 28, 2006

(65) Prior Publication Data

US 2007/0194996 A1 Aug. 23, 2007

(30) Foreign Application Priority Data

Feb. 20, 2006 (TW) ..... 95105666 A

(51) Int. Cl.
*H01Q 1/24* (2006.01)

(52) U.S. Cl. ..... 343/702; 343/878

(58) Field of Classification Search ..... 343/700 MS, 343/878, 702, 873
See application file for complete search history.

(56) References Cited

U.S. PATENT DOCUMENTS 6,642,907 B2 * 11/2003 Hamada et al. ..... 343/873
2007/0164420 A1 * 7/2007 Chen et al. ..... 257/691

* cited by examiner

*Primary Examiner*—Tan Ho
(74) *Attorney, Agent, or Firm*—Thomas, Kayden, Horstemeyer & Risley

(57) ABSTRACT

A connection apparatus for a chip antenna includes a connection base and at least one chip slot. The connection base is disposed on a circuit board and connects to the electronic components of the circuit board via a connection wire. The chip slot is disposed on the connection base for inserting the chip antenna. Thus, the chip antenna is connected to the electronic components of the circuit board via the connection wire.

24 Claims, 18 Drawing Sheets

$\alpha = 0^\circ$

X-Y plane $\alpha = 45^\circ$

X-Y plane $\alpha = 90^\circ$

X-Y plane $\alpha = 0^\circ$

X-Z plane $\alpha = 90^\circ$

X-Y plane $\alpha = 0^\circ$

X-Z plane

CHIP ANTENNA MOUNTING APPARATUS

RELATED APPLICATIONS

The present application is based on, and claims priority from, Taiwan Application Serial Number 95105666, filed Feb. 20, 2006, the disclosure of which is hereby incorporated by reference herein in its entirety.

BACKGROUND

1. Field of Invention

The present invention relates to a chip antenna mounting apparatus. More particularly, the present invention relates to an apparatus that provides a connection to a chip antenna on a circuit board.

2. Description of Related Art

There is rapid growth in the wireless communication sector, for example, cell phones, computer and Wi-Fi network, which utilize the wireless communication to transmit and receive signals. Wireless communication uses a signal transceiver and a signal transceiver antenna transmit and receive signals. The traditional antenna, for example, rod antenna, yagi antenna and dish antenna, cannot satisfy the current trends which require low cost and compliance with the requirements of light, thin, short and with small volume. Therefore, a chip antenna is developed to comply the requirements of the foregoing objectives.

The connection between the chip antenna and the circuit board is the critical step in the antenna manufacturing technique. The conventional method uses electrical conducting glue, direct molding or soldering to attach the chip to the PCB for connectivity. The soldering, in general, is the most common method to connect the chip antenna and the circuit board. The soldering method can obtain a good connection result if there is good control on the soldering current. However, there are many factors that need to be taken into consideration in the manufacturing process (for example, the defects causes by the solder skip and dry joint etc).

In other aspects, the molding, binding and soldering method for connecting the chip antenna and the circuit board usually requires an empty area on the circuit board. The antenna radiation pattern cannot be adjusted accordingly due to the fixed position of the antenna. Further, the soldering method is difficult to solder the chip antenna vertical to the circuit board and it lacks stable support which results in an unreliable connection.

A planar Inverted-F Antenna (PIFA) is adopted to overcome the volume of the antenna. However, the PIFA still requires a large empty space on the circuit board.

For the forgoing reasons, there is a need for an improved connection method between a chip antenna and a circuit board to solve the support problem when using the soldering method. Moreover, the radiation pattern of the chip antenna can be adjusted according to the requirements, and can be to reduce the empty space needed in the circuit board to further achieve the smaller volume when connecting the chip antenna on the circuit board.

SUMMARY

It is therefore an objective of the present invention to provide a stable support for a chip antenna mounting apparatus to connect a chip antenna and a circuit board to form a required antenna radiation pattern, and reduce empty space on the circuit board to further achieve smaller volume when connecting the chip antenna on the circuit board.

In accordance with the foregoing objectives of the present invention, a chip antenna mounting apparatus includes a connection base and at least one chip slot. The connection base is disposed on a circuit board and has a connection wire to connect the electronic components of the circuit board. The chip slot is disposed on the connection base. The chip antenna is inserted into the chip slot and connects with the electronic components of the circuit board via the connection wire.

The other objectives of the present invention are to provide a connection apparatus on a circuit board to connect a chip antenna and to reduce the empty space required for the chip antenna. The connection apparatus utilizes a coupling effect between the circuit board and a ground area and adjusts the angle between the chip antenna and the surface of the connection base to achieve the required radiation pattern.

In accordance with the preferred embodiment of the present invention, the connection apparatus on a circuit board for connecting a chip antenna includes a circuit board, a chip antenna, a connection base and at least one chip slot. The connection base is disposed on the circuit board and has a connection wire to connect the electronic components of the circuit board. The chip slot is disposed on the connection base. The chip antenna is inserted into the chip slot and connects with the electronic components of the circuit board via the connection wire. The circuit board further includes a ground area located near one side or the other side of the corresponding chip antenna.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
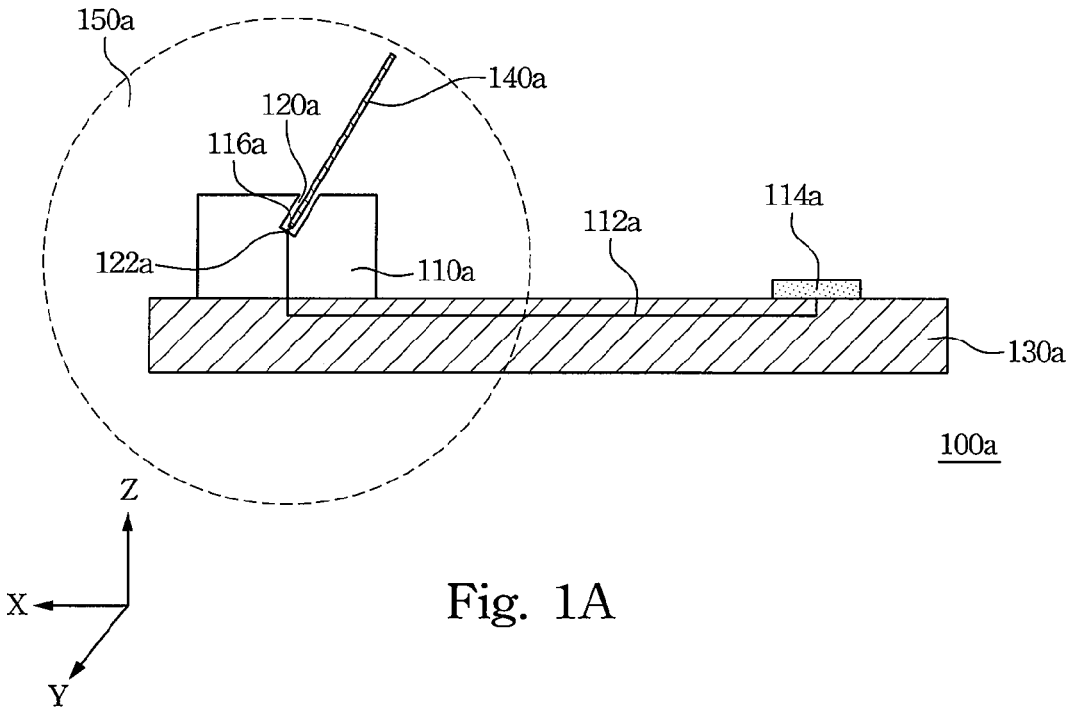
FIG. 1A is a lateral view of one preferred embodiment for the present invention.

FIG. 1A illustrates a lateral view of a chip antenna mounting apparatus 150*a* of one preferred embodiment for the present invention. The chip antenna mounting apparatus 150*a* includes a connection base 110*a*, a connection wire 112*a* and at least a chip slot 120*a*. The connection base 110*a* is disposed on a circuit board 130*a*. The connection base 110*a* includes a connection wire 112*a* to connect the electronic components 114*a* of the circuit board 130*a*. At least one chip slot 120*a* is disposed on the connection base 110*a* to insert the chip antenna 140*a*. The chip antenna 140*a* is connected to the electronic components 114*a* of the circuit board 130*a* via the connection wire 112*a*.

In addition, the chip slot 120*a* has a connection point 122*a* to connect a feed-in point 116*a* of the chip antenna 140*a* for signal transmission. Generally, the feed-in point 116*a* of the chip antenna 140*a* may be a signal terminal of the chip antenna 140*a* or any part of the chip antenna 140*a* for signal transmission. Further, the position of the connection point 122*a* of the chip slot 120*a* is disposed accordingly to the feed-in point 116*a* of the chip antenna 140*a*. For example, the feed-in point 116*a* and the position of the connection point 122*a* are disposed respectively on the bottom or on the side of the chip antenna 140*a* and the chip slot 120*a*. Or the feed-in point 116*a* is disposed on both sides of the chip antenna 140*a* according to the connection point 122*a*. Alternatively, the connection point 122*a* is disposed on both sides of the chip slot 120*a* according to the feed-in point 116*a*.

Referring to FIG. 1A, the connection type of the connection point 122*a* of chip slot 120*a* can be designed according to the product needs, for example, edge connector, pin or other connection types. The foolproof device might be incorporated when designing the chip slot 120*a* to prevent the incorrect insertion of the chip antenna 140*a*.

Conventional techniques usually design the chip antenna disposed flat on the circuit board. This requires an empty area around the chip antenna on the circuit board to prevent the interference from metal or other components of the circuit board which affect the radiation pattern of the chip antenna. However, the preferred embodiment of the invention for the position of the chip antenna 140*a* is not disposed flat on the circuit board 130*a* and instead there is a separation distance between the chip antenna 140*a* and the circuit board 130*a*. Therefore, there is no need to leave a large empty space to prevent interference as in the conventional method. This shows the preferred embodiment can effectively reduce the needed space for the chip antenna 140*a* on the circuit board 130*a*. In another aspect, the chip antenna 140*a* is connected via the chip antenna mounting apparatus 150*a* to the circuit board 130*a* in a standing position and is separated from the circuit board 130*a*. Consequently, the radiation pattern from the preferred embodiment is not easily influenced by the metal or other components of the circuit board 130*a*.

Figure 1B:
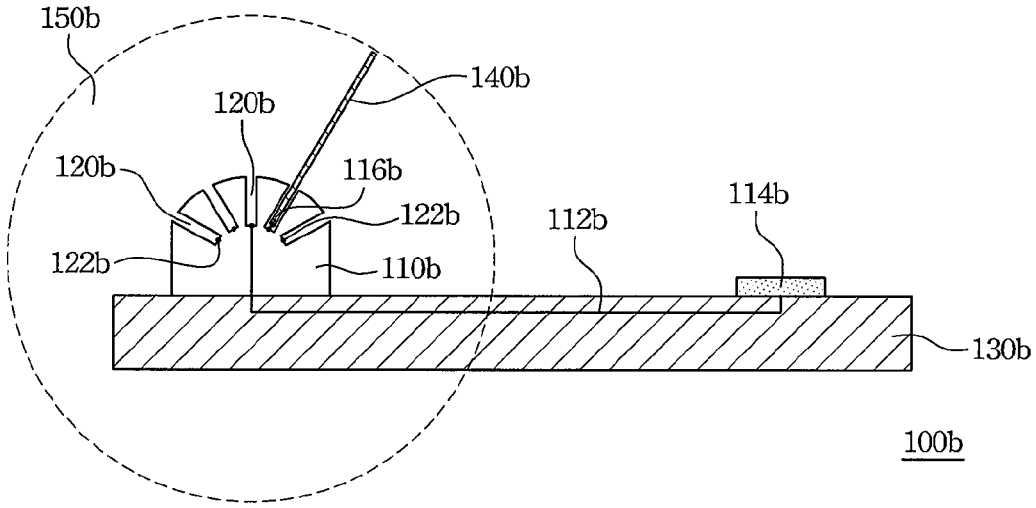
FIG. 1B is a lateral view of another preferred embodiment for the present invention.

FIG. 1B illustrates a lateral view of a chip antenna mounting apparatus 150*b* of another preferred embodiment for the present invention. The chip antenna mounting apparatus 150*b* includes a connection base 110*b*, and a plurality of chip slots 120*b*. An angle exists between each of the chip slots 120*b* and a surface of the connection base 110*b*, wherein each of the angles is different. Therefore the chip antenna 140*b* can use different chip slots 120*b* according to the required radiation pattern. Further, each of the chip slots 120*b* has a connection point 122*b* to provide the connection with a feed-in point of the chip antenna 140*b* for signal transmission.

Please refer to FIG. 1A and FIG. 1B, the chip antenna mounting apparatus 150*a*/150*b* further comprise an adjustable knob (not shown) to adjust an angle of the chip slot(s) 120*a*/120*b* to a surface of the connection base 110*a*/110*b*. The chip slot(s) 120*a*/120*b* having the adjustable knob can be seen as an adjustable chip slot, which is capable of selectively adjusting the angle between the chip slot(s) 120*a*/120*b* and the surface of the connection base 110*a*/110*b*.

Moreover, the chip slot(s) 120*a*/120*b* disposed on the connection base 110*a*/110*b* is a fixed or a pluggable chip slot. For example, the fixed chip slot fixes the chip antenna on the connection base 110*a*/110*b* directly. The pluggable chip slot can be simply and easily plugged in and pulled out from the connection base 110*a*/110*b* and can be changed according to the requirement.

Figure 1C:
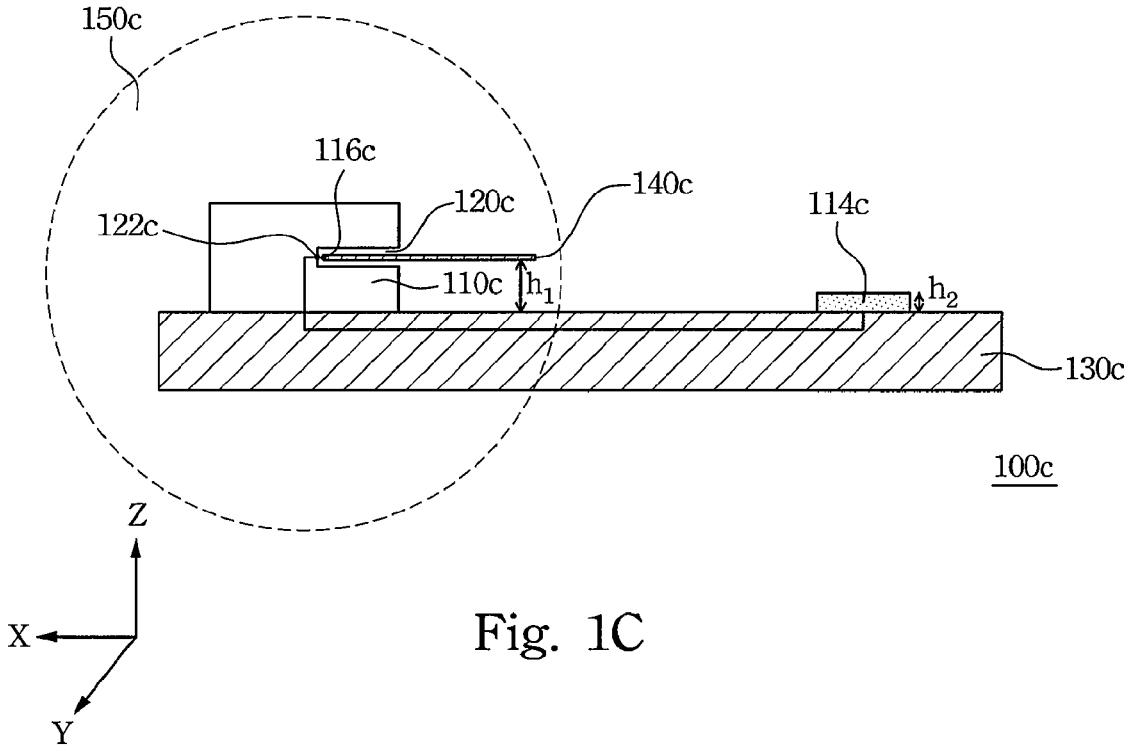
FIG. 1C is a lateral view of another preferred embodiment for the present invention.

FIG. 1C illustrates a lateral view of a chip antenna mounting apparatus 150*c* of another preferred embodiment for the present invention. The position of the chip slot 120*c* is arranged to be above the electronic components of the circuit board 130*c*. Therefore, the height h1 of the chip antenna 140*c* placed on the circuit board 130*c* is higher than the height h2 of the electronic components 114*c* placed on the circuit board 130*c*. The interference from the metal and the electronic components of the circuit board 130*c* for the radiation pattern of the chip antenna 140*c* is reduced because the chip antenna 140*c* is above the electronic components on the circuit board 130*c*. Therefore there is no need to have an empty area to prevent interference from electronic components on the circuit board 130*c*. Further, there is a ground area (not shown) on the circuit board 130*c* corresponding to the chip antenna 140*c* for the coupling effect between the chip antenna 140*c* and the ground area.

In another aspect, the present invention can be seemed as a disclosure of an apparatus having a chip antenna 100*a*. Refer to FIG. 1A, the apparatus having the chip antenna 100*a* includes a connection base 110*a*, a connection wire 112*a*, a chip slot 120*a*, a circuit board 130*a* and a chip antenna 140*a*. The connection base 110*a* is disposed on the circuit board 130*a*. The connection base 110*a* has a connection wire 112*a* to connect the electronic components 114*a* of the circuit board 130*a*. The chip slot 120*a* is disposed on the connection base 110*a* so the chip antenna 140*a* can be inserted in the chip slot 120*a*. The chip antenna 140*a* is connected to the components 114*a* of the circuit board 130*a* via the connection wire 112*a*.

In another aspect, the present invention can be seen as a disclosure of an apparatus having a chip antenna 100*b*. Please refer to FIG. 1B, the apparatus having the chip antenna 100*b* includes a connection base 110*b*, a connection wire 112*b*, at least one chip slot 120*a*, a circuit board 130*b* and a chip antenna 140*b*. The connection base 110*b* is disposed on the circuit board 130*b*. The connection base 110*b* has the connection wire 112*b* to connect the electronic components 114*b* of the circuit board 130*b*. The chip slot

120*b* is disposed on the connection base 110*b* so the chip antenna 140*b* can be inserted into the chip slot 120. The chip antenna 140*b* is connected to the components 114*b* of the circuit board 130*b* via the connection wire 112*b*.

Please refer to FIG. 1A and FIG. 1B, the connection structure of the connection base 110*a*, 110*b*, chip slot(s) 120*a*, 120*b*, circuit board 130*a*, 130*b* and chip antenna 140*a*, 140*b* are described above in the apparatus with the chip antenna 150*a* and 150*b*.

The following section describes the relationship between the angle α and the antenna pattern when the chip antenna 140*b* on the apparatus 100*b* has a center frequency of 2.4 GHz. In the preferred embodiment in FIG. 1*b* there is an angle α (for example, 0 degree, 45 degrees or 90 degrees) between the chip antenna 120*b* and the surface of the connection base 110*b*. The antenna pattern formed by the angle α (for example, 0 degree, 45 degrees or 90 degrees) of the chip antenna 140*b* on plane XY, XZ and YZ plane is explained below.

Figure 2A:
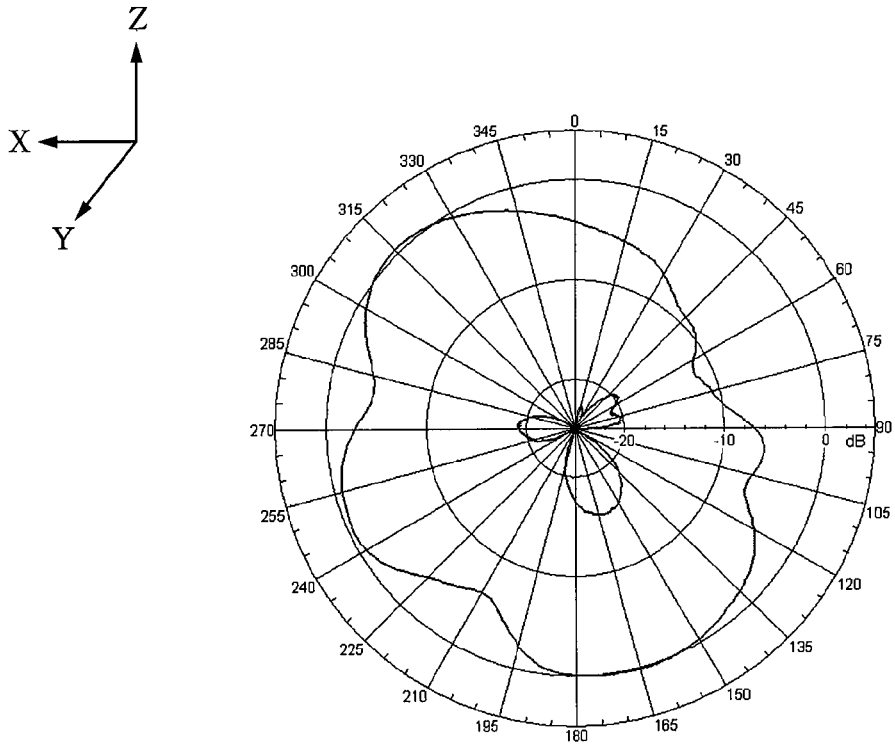
FIG. 2A~2I are the antenna pattern graphs illustrated when a center frequency is 2.4 GHz for the chip antenna of FIG. 1B.
Figure 2B:
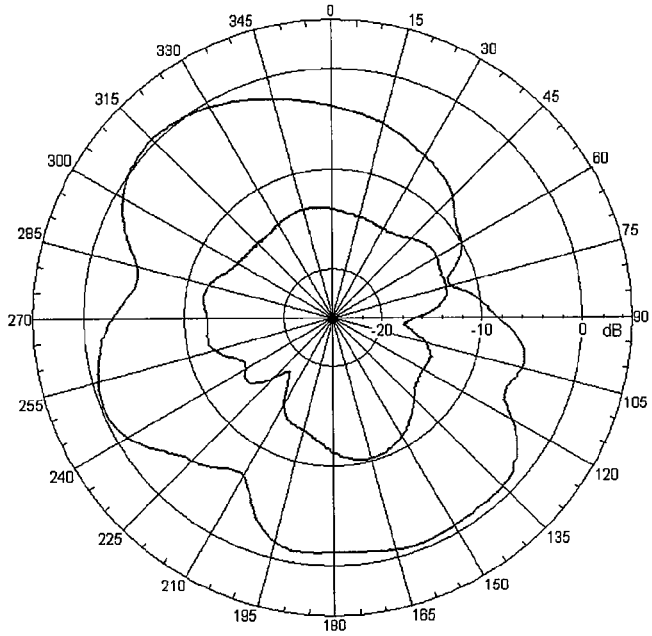
Figure 2C:
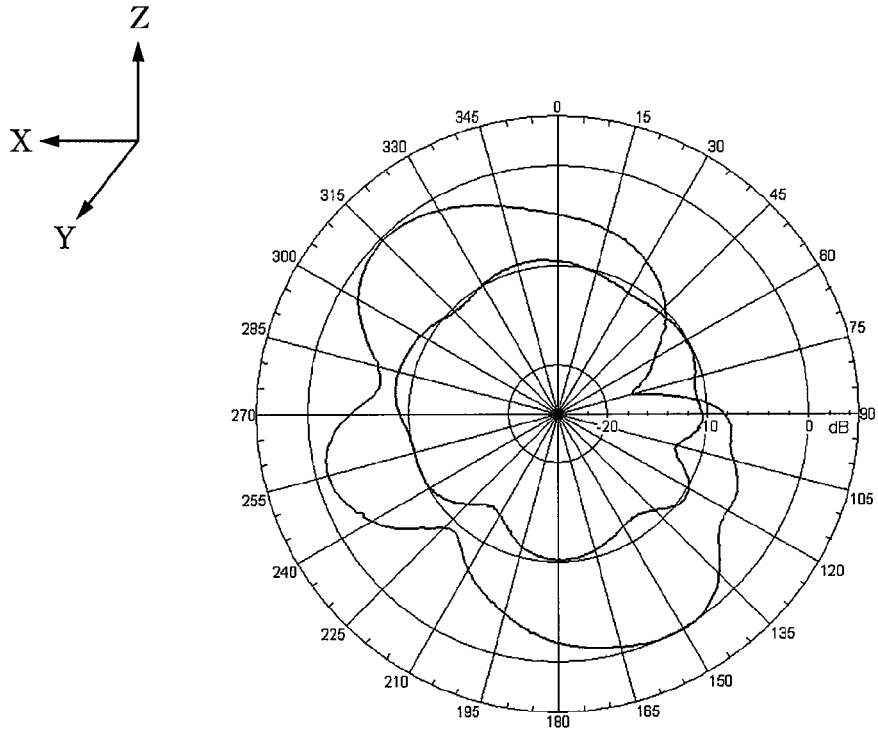
Figure 2D:
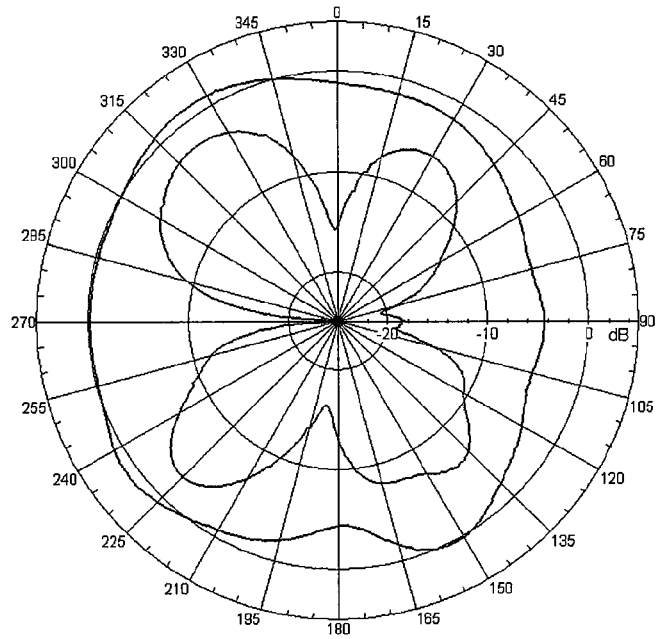
Figure 2E:
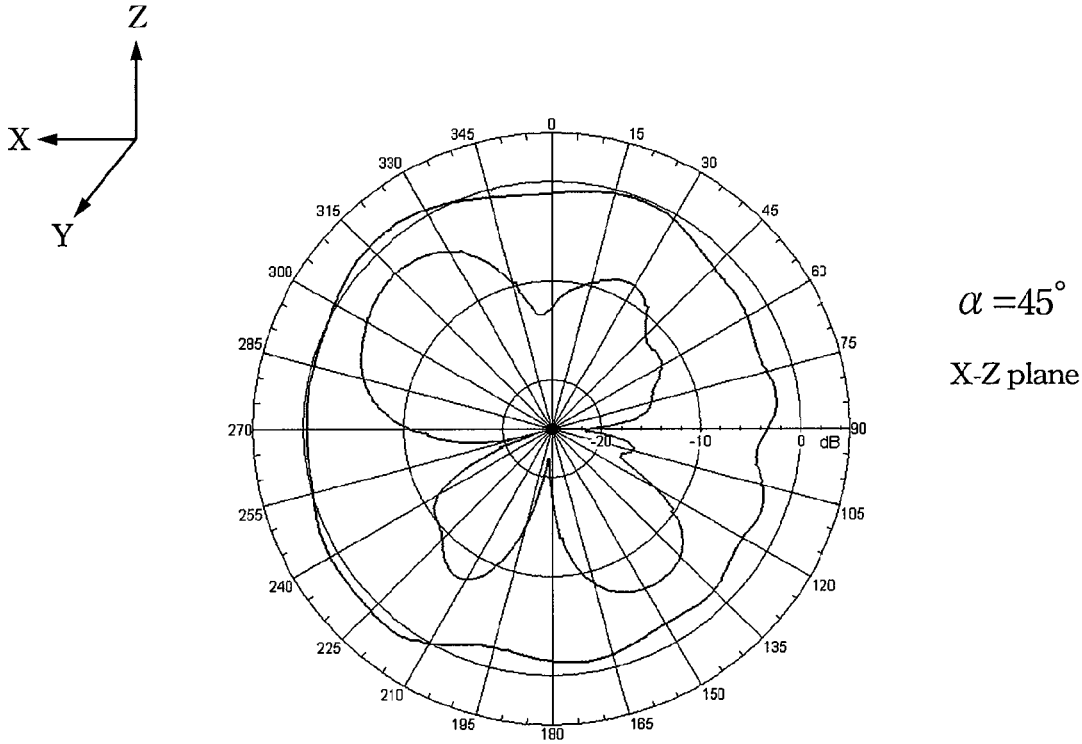
Figure 2F:
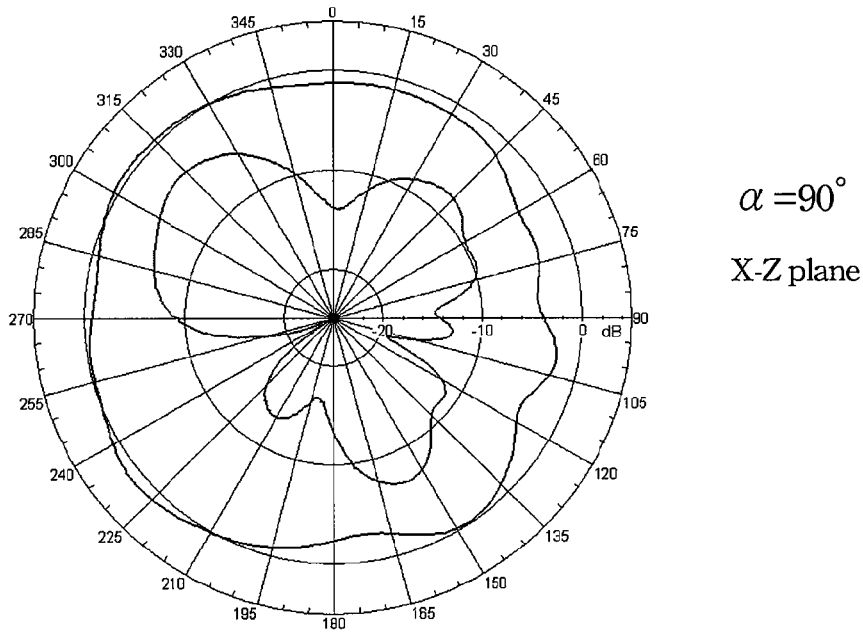
Figure 2G:
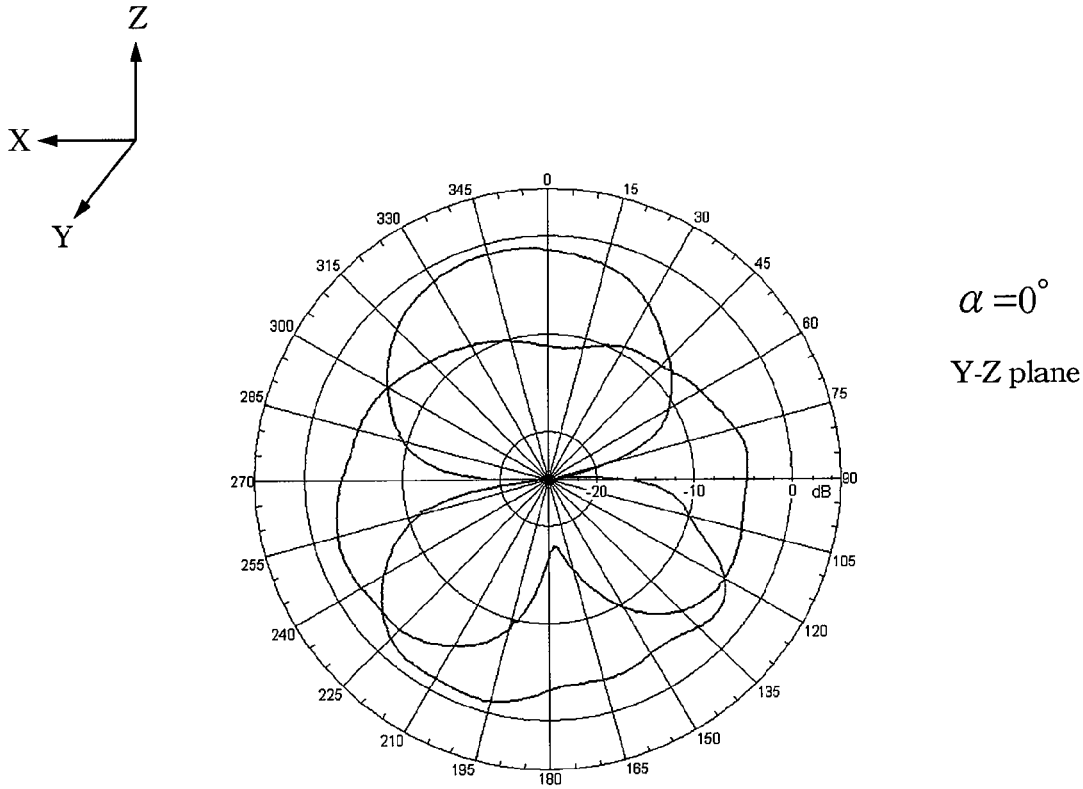
Figure 2H:
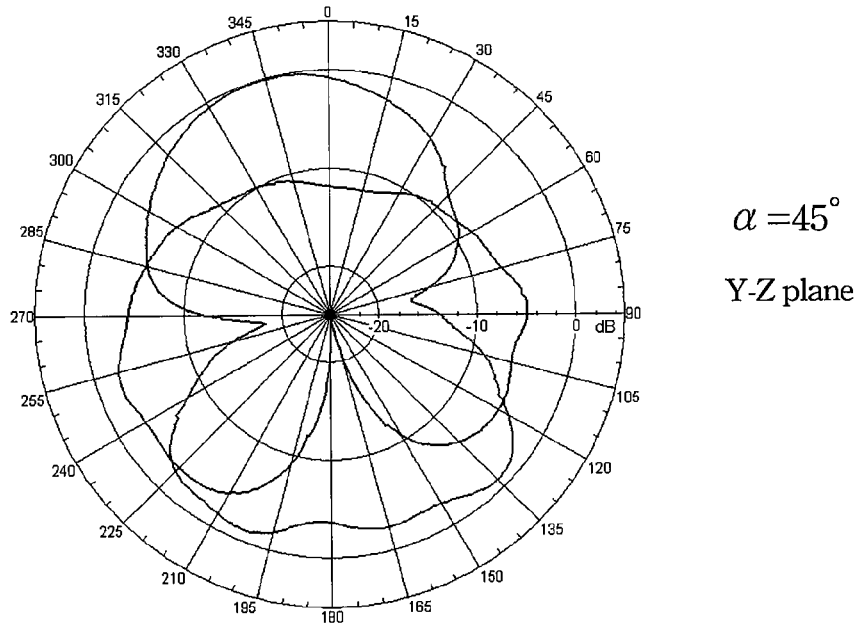
Figure 2I:
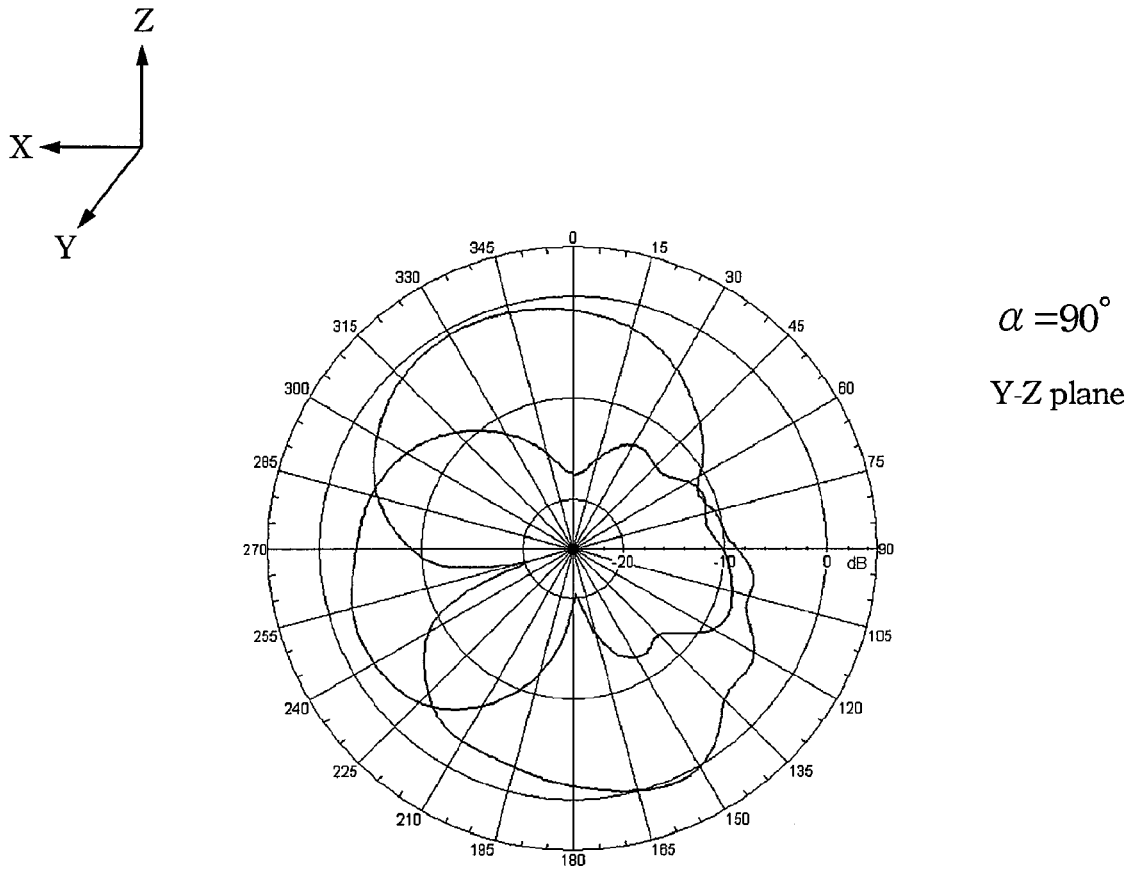

FIG. 2A, FIG. 2B and FIG. 2C are the antenna pattern graphs for the X-Y plane when there is an angle α of 0 degree, 45 degrees and 90 degrees respectively between the chip antenna 140*b* and the surface of the connection base 110*b*, and when the center frequency is 2.4 GHz for the chip antenna 140*b* of the preferred embodiment. FIG. 2D, FIG. 2E and FIG. 2F are the antenna pattern graphs for the X-Z plane when there is an angle α of 0 degree, 45 degrees and 90 degrees respectively between the chip antenna 140*b* and the surface of the connection base 110*b*, and when the center frequency is 2.4 GHz for the chip antenna 140*b* of the preferred embodiment. FIG. 2G, FIG. 2H and FIG. 2I are the antenna pattern graphs for the Y-Z plane when there is an angle α of 0 degree, 45 degrees and 90 degrees respectively between the chip antenna 140*b* and the surface of the connection base 110*b*, and when the center frequency is 2.4 GHz for the chip antenna 140*b* of the preferred embodiment.

FIG. 2A~2I show the antenna pattern changes according to the angle α between the chip antenna 140*b* and the surface of the connection base 110*b* when the center frequency is 2.4 GHz for the chip antenna 140*b* of X-Y plane of the apparatus with a chip antenna 100*b*. Further, the chip antenna gain changes according to the angle α. The chip antenna gain is measured by dBi to indicate the ability to receive and transmit the signal in a particular direction for the chip antenna 140*b*. The higher the chip antenna gain, the better the cover range for radio wave.

FIG. 2A~2C (X-Y plane) shows the chip antenna gain is 0.44 dBi, 0.41 dBi and −0.01 dBi when the angle α between the chip antenna 140*b* and the surface of the connection base 110*b* is 0 degree, 45 degrees and 90 degrees respectively. FIG. 2D~2F (X-Z plane) shows the chip antenna gain is 1.12 dBi, 1.07 dBi and 1.03 dBi when the angle α between the chip antenna 140*b* and the surface of the connection base 110*b* is 0 degree, 45 degrees and 90 degrees respectively. FIG. 2G~2I (Y-Z plane) shows the chip antenna gain is −1.04 dBi, −0.09 dBi and 0.35 dBi when the angle α between the chip antenna 140*b* and the connection base 110*b* is 0 degree, 45 degrees and 90 degrees respectively. Therefore, the required antenna pattern and the ideal cover range of the radio wave can be achieved by changing the angle α between the chip antenna 140*b* and the connection base 110*b* according to the requirement of the product.

The following describes the relationship between the antenna pattern and the angle α when the center frequency of the chip antenna 140*b* is 5 GHz for the chip antenna apparatus 100*b*, and refer to FIG. 1.

Figure 3A:
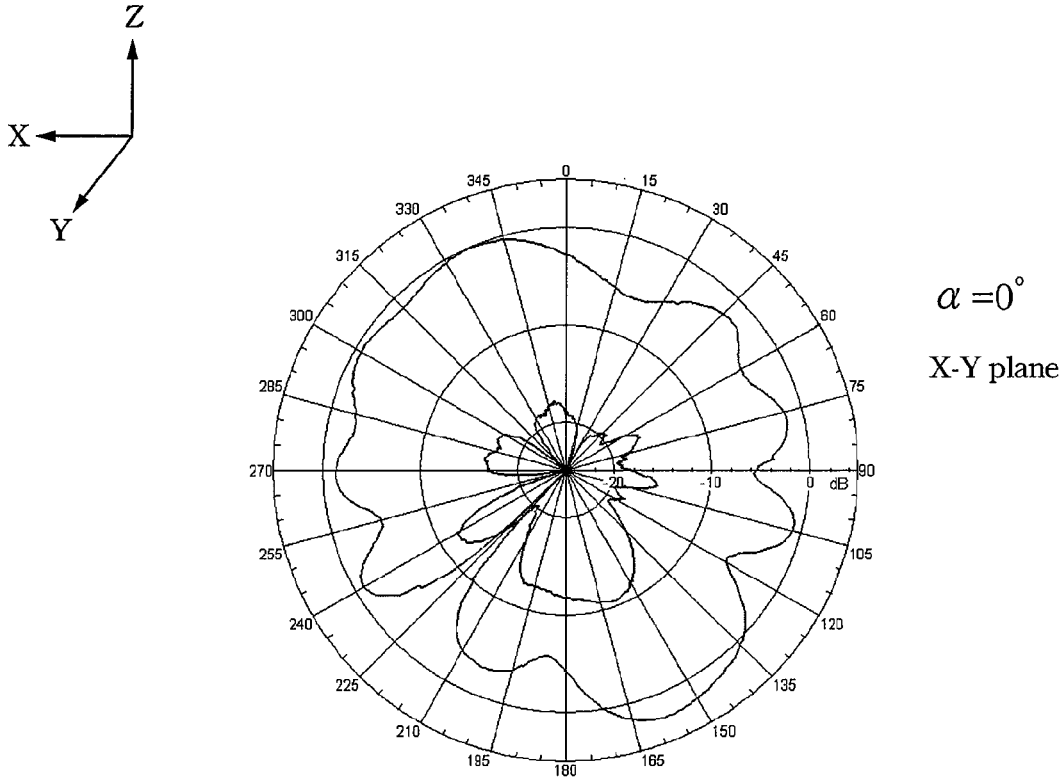
FIG. 3A~3I are the antenna pattern graphs illustrated when a center frequency is 5 GHz for the chip antenna of FIG. 1B.
Figure 3B:
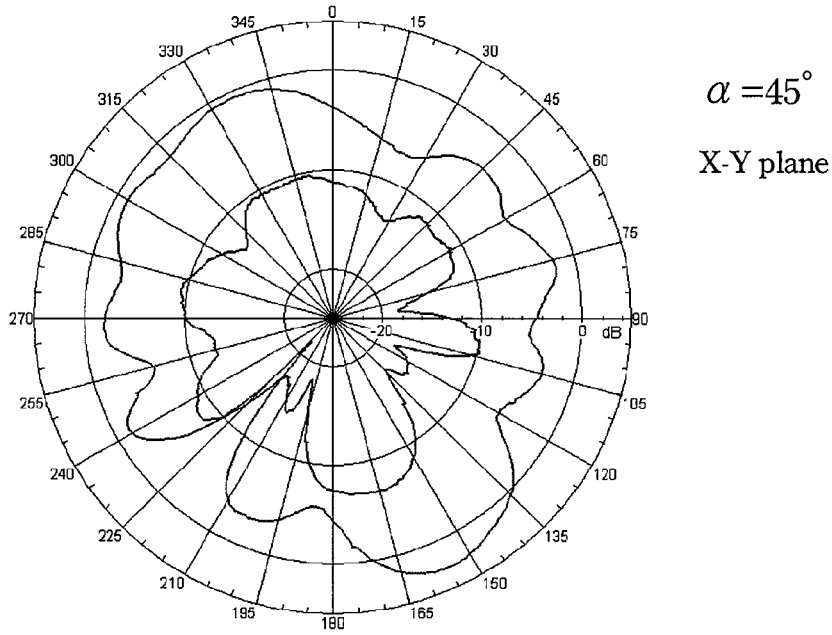
Figure 3C:
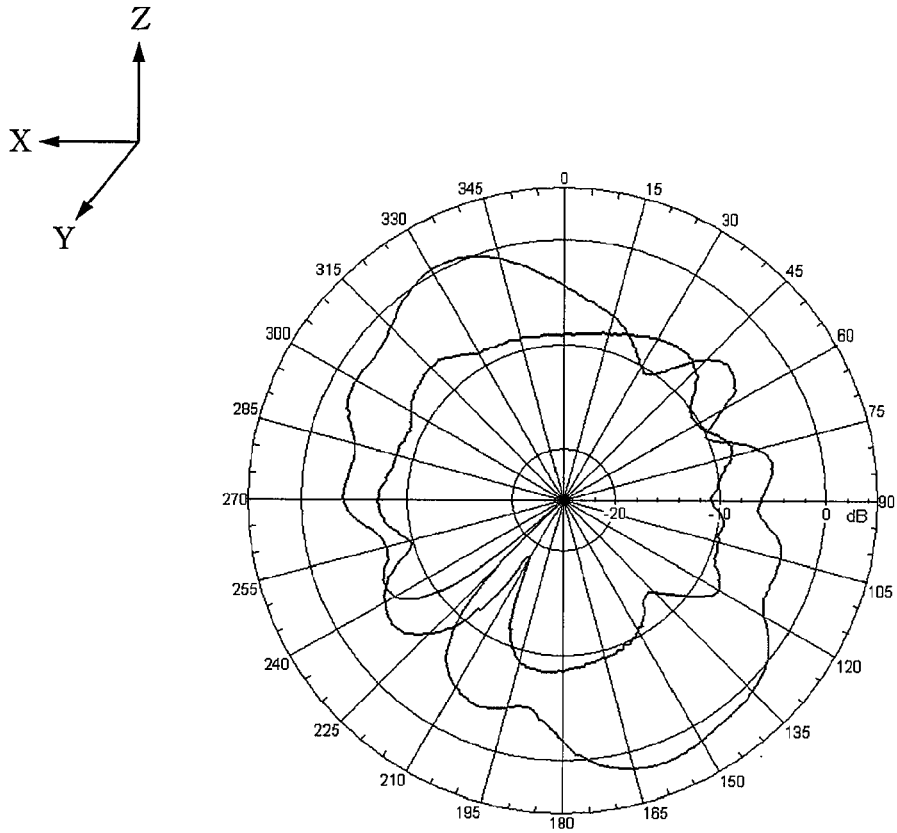
Figure 3D:
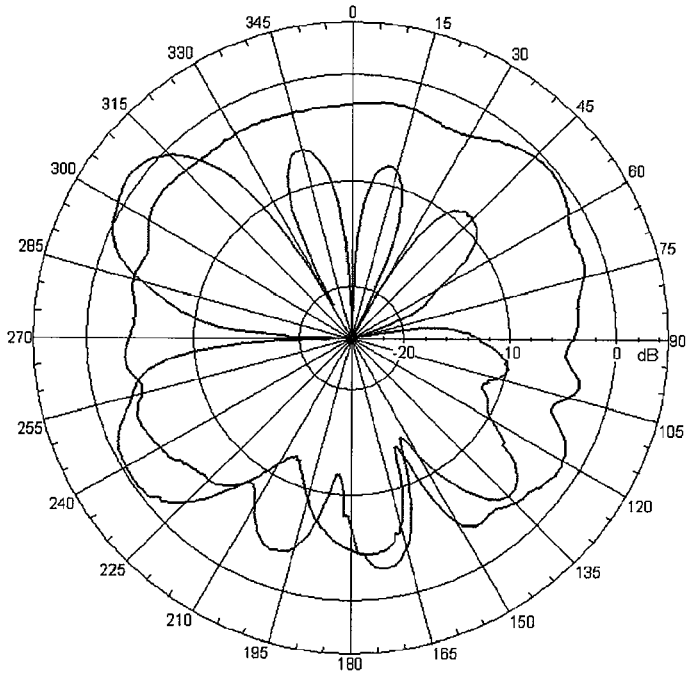
Figure 3E:
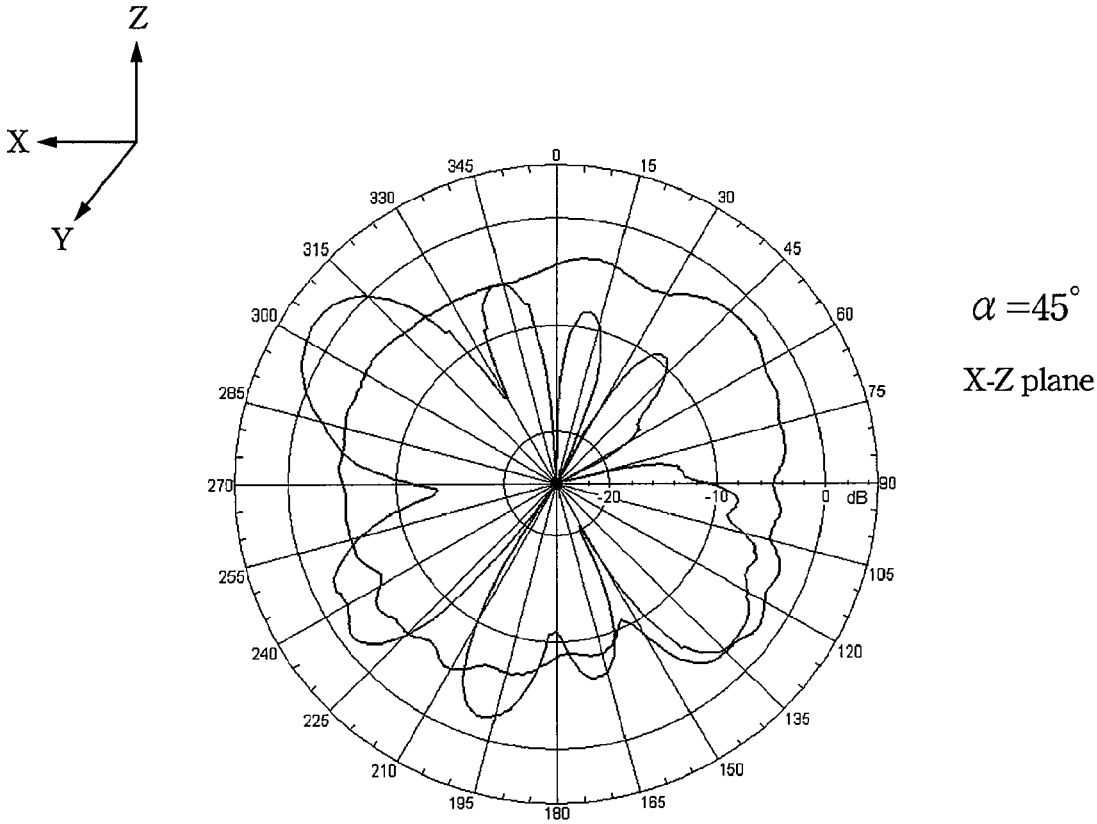
Figure 3F:
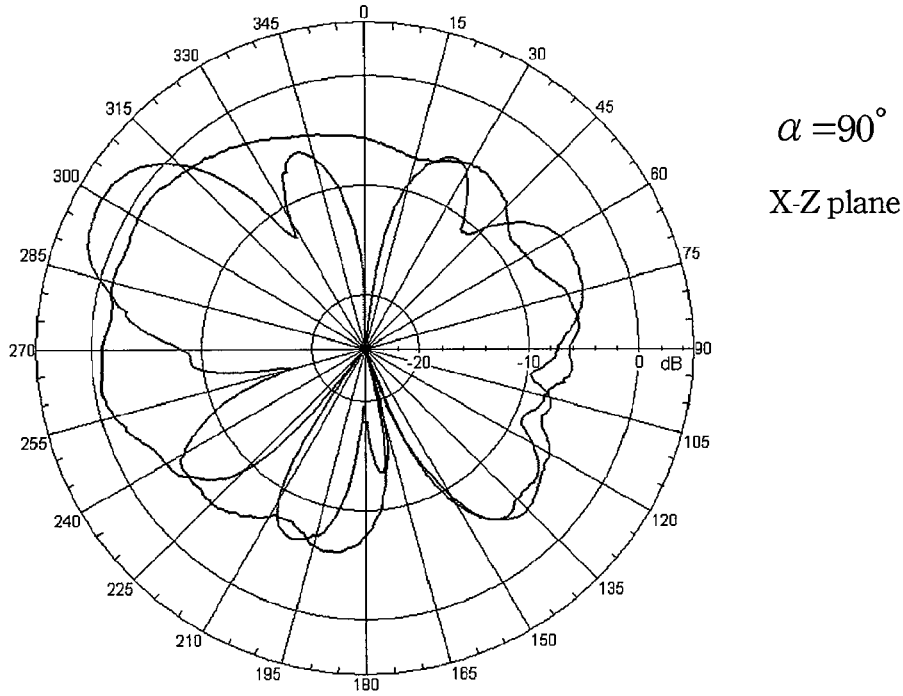
Figure 3G:
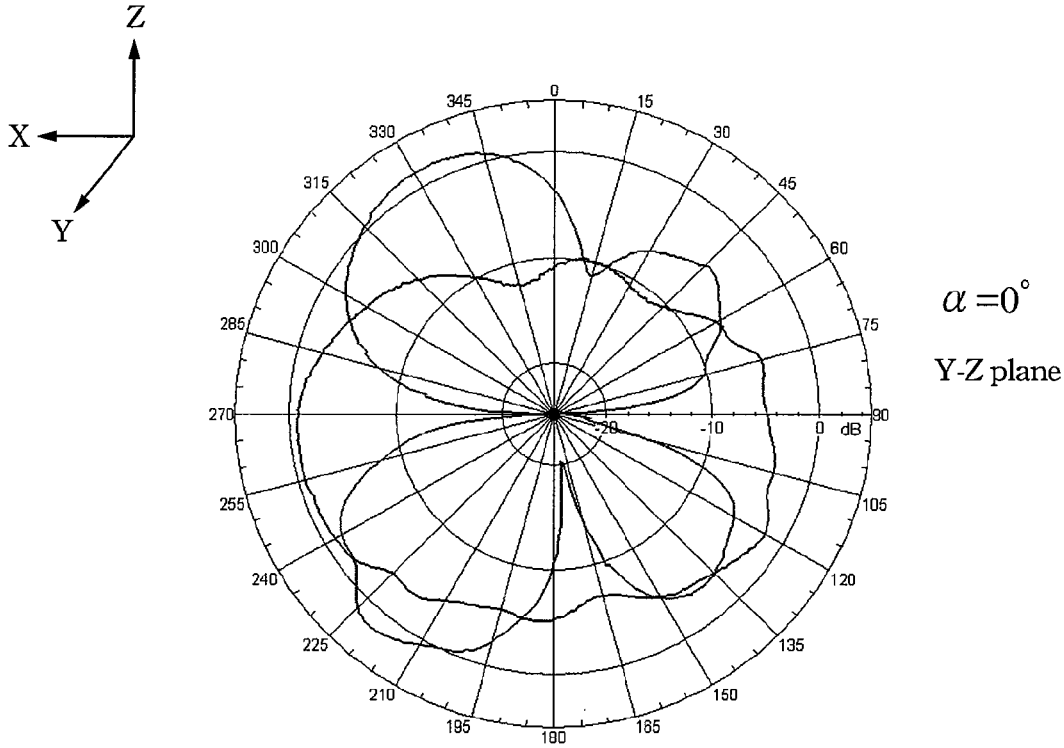
Figure 3H:
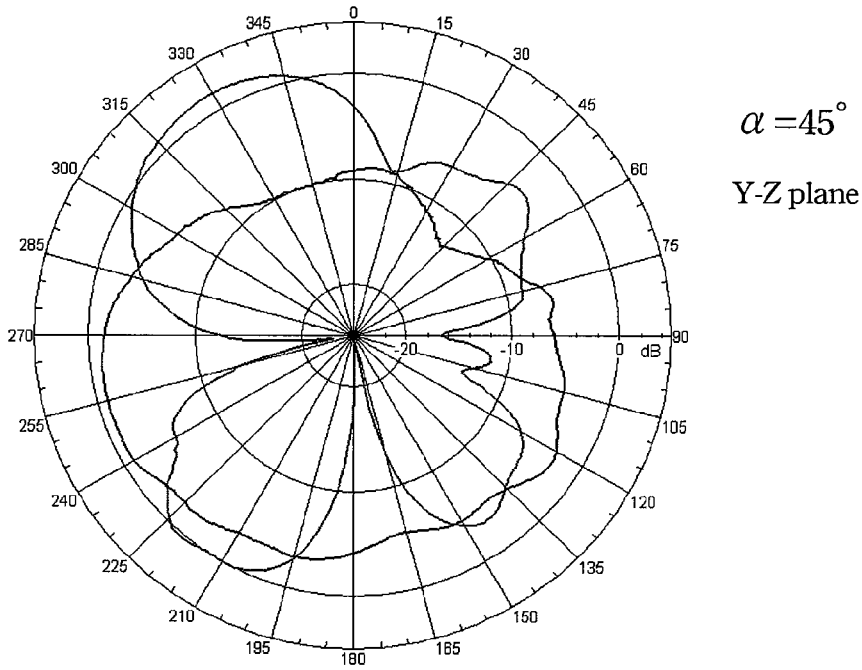
Figure 3I:
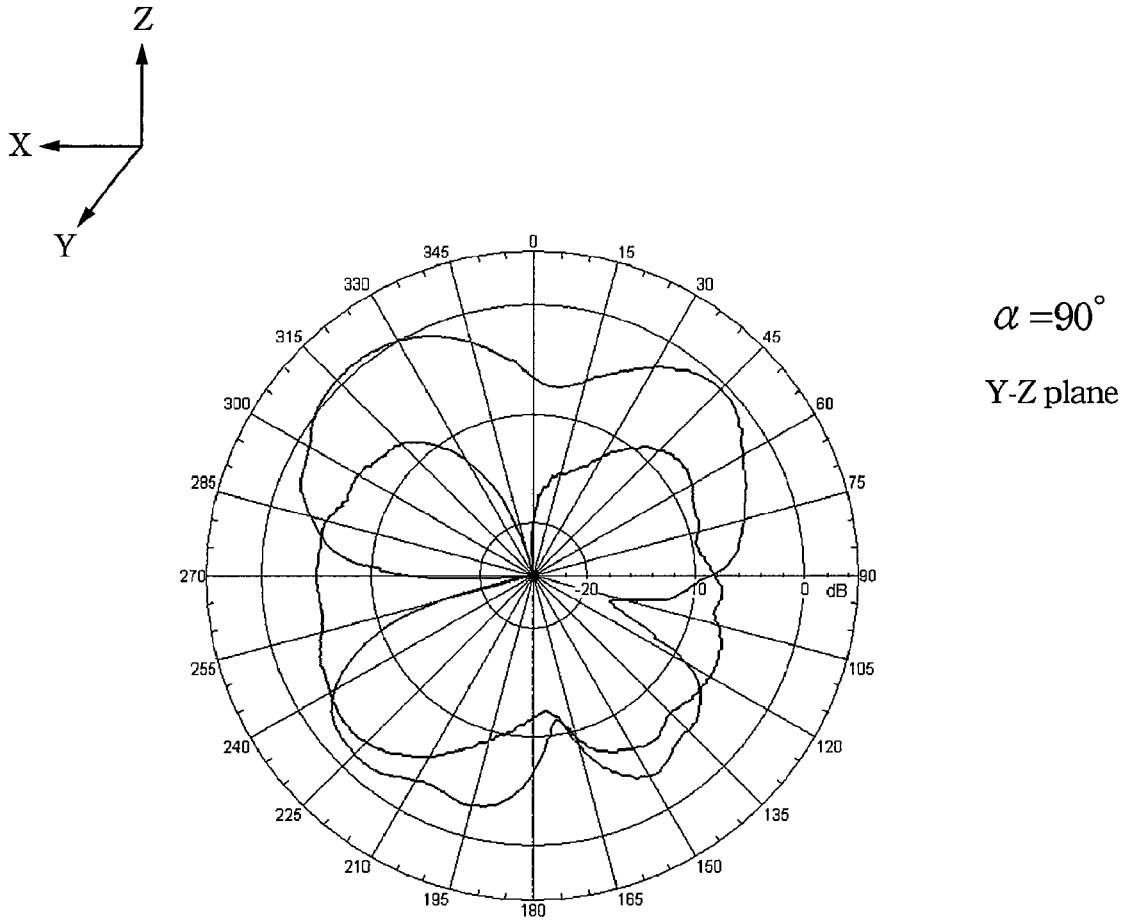

FIG. 3A, FIG. 3B and FIG. 3C are the antenna pattern graphs for the X-Y plane when there is an angle α of 0 degree, 45 degrees and 90 degrees respectively between the chip antenna 140*b* and the surface of the connection base 110*b*, and when the center frequency is 5.0 GHz of the chip antenna 140*b* of the preferred embodiment. FIG. 3D, FIG. 3E and FIG. 3F are the antenna pattern graphs for the X-Z plane when there is an angle α of 0 degree, 45 degrees and 90 degrees respectively between the chip antenna 140*b* and the surface of the connection base 110*b*, and when the center frequency is 5.0 GHz of the chip antenna 140*b* of the preferred embodiment. FIG. 3G, FIG. 3H and FIG. 3I are the antenna pattern graphs for the Y-Z plane when there is an angle α of 0 degree, 45 degrees and 90 degrees respectively between the chip antenna 140*b* and the surface of the connection base 110*b*, and when the center frequency is 5.0 GHz of the chip antenna 140*b* of the preferred embodiment.

FIG. 3A~3I show the antenna pattern changes according to the angle α between the chip antenna 140*b* and the surface of the connection base 110*b* when the center frequency is 5 GHz for the chip antenna 140*b* of XY plane of chip antenna connection device 100*b*. Further, the chip antenna gain changes according to the angle α.

FIG. 3A~3C (X-Y plane) shows the chip antenna gain is 2.37 dBi, 2.78 dBi and 1.87 dBi when the angle α between the chip antenna 140*b* and the surface of the connection base 110*b* is 0 degree, 45 degrees and 90 degrees respectively. FIG. 3D~3F (X-Z plane) shows the chip antenna gain is 1.02 dBi, 2.16 dBi and 2.63 dBi when the angle α between the chip antenna 140*b* and the surface of the connection base 110*b* is 0 degree, 45 degrees and 90 degrees respectively. FIG. 3G~3I (Y-Z plane) shows the chip antenna gain is 1.69 dBi, 1.72 dBi and 0.64 dBi when the angle α between the chip antenna 140*b* and the connection base 110*b* is 0 degree, 45 degree and 90 degree respectively. Therefore, the required antenna pattern and the ideal cover range for the radio wave can be achieved by changing the angle α between the chip antenna 140*b* and the connection base 110*b* according to the requirement of the product.

Figure 4:
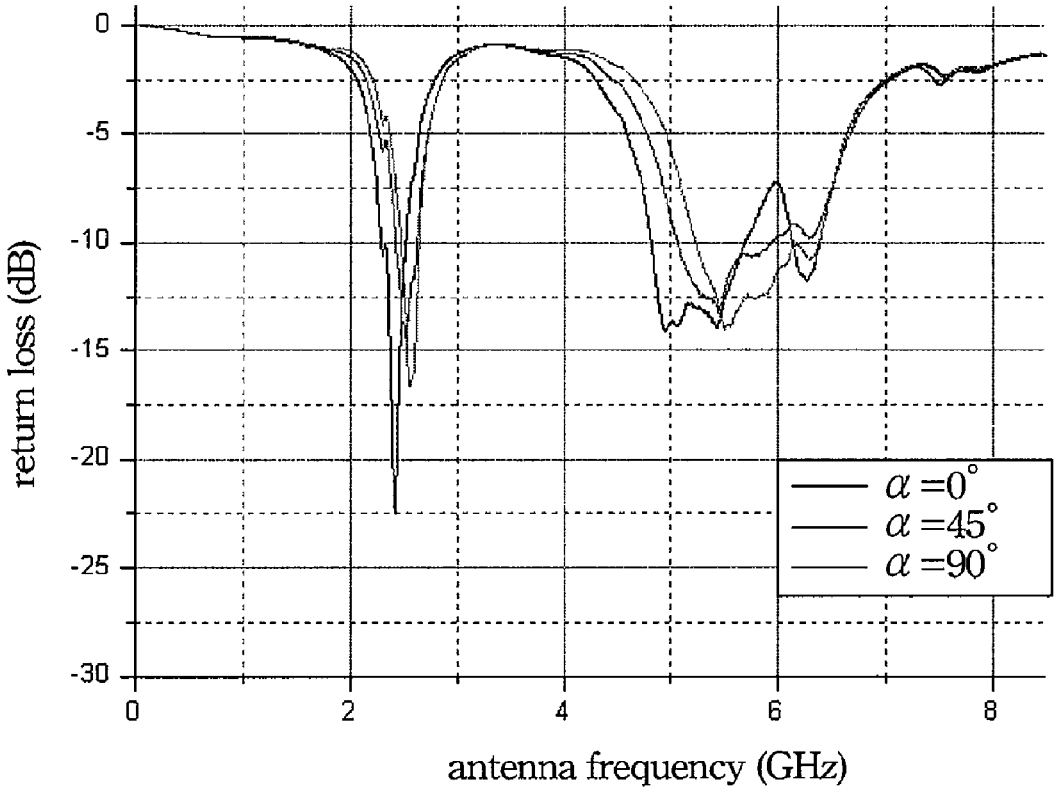
FIG. 4 illustrates a graph of return loss versus frequency response of chip antenna of FIG. 1B.

FIG. 4 illustrates a return loss versus frequency response graph of the chip antenna of FIG. 1B. The vertical axis is the return loss measured in dB and the horizontal axis is the frequency of the chip antenna 140*b* measured in GHz. FIG. 4 shows the same return loss and when the angle α is 0 degree, 45 degrees or 90 degrees respectively between the chip antenna 140*b* and the connection base 110*b* resulting in a shift of the frequency response of the chip antenna 140*b*. Therefore, the angle α of the chip antenna 140*b* and the connection base 110*b* can be adjusted accordingly to obtain the required frequency response of the chip antenna 140*b*.

Moreover, the circuit board 130*b* further includes a ground area (not shown) in the apparatus having the chip antenna 100*b*. The ground area is located near one side or the other side of the corresponding chip antenna 140*b* on the circuit board 130*b* for the coupling effect between the chip antenna 140*b* and the ground area.

The ground area is made from a metal, alloy or other electrically conductive material, for example, copper. The chip antenna includes a dielectric layer and a wire. The surface of the chip antenna 140*b* can be a dielectric material and the wire can be a metal, alloy or other electrically conductive material, for example, copper.

Figure 5A:
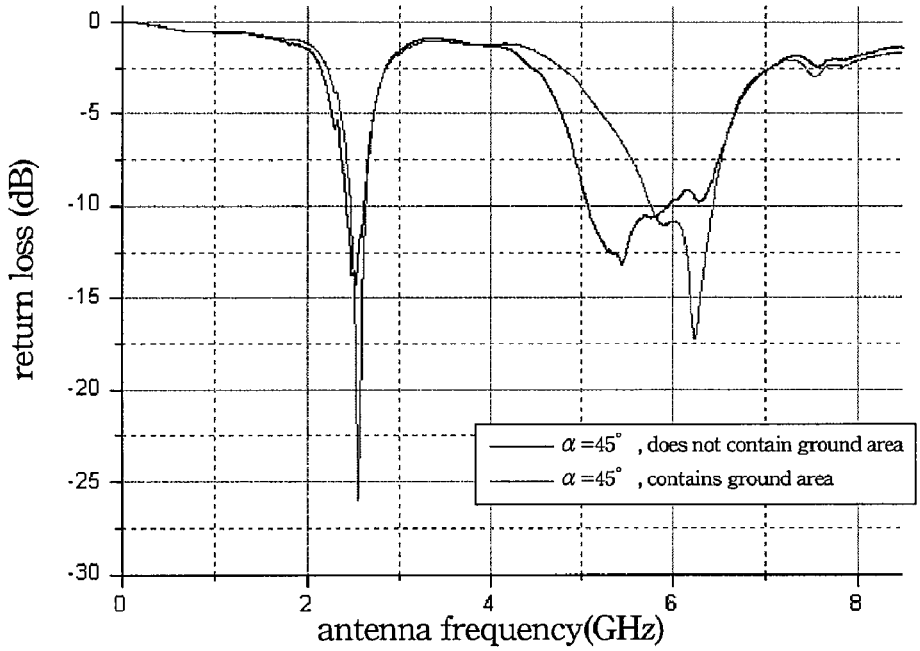
FIG. 5A is a graph of return loss versus frequency response when there is a 45 degree angle between a chip antenna and a connection base, and a circuit board contains/does not contain a ground area of the chip antenna mounting apparatus of FIG. 1B.

FIG. 5A is a return loss versus frequency response graph when there is a 45 degree angle between the chip antenna 140*b* and the surface of a connection base 110*b*, and the circuit board 130*b* contains/does not contain a ground area shown in FIG. 1B. Dielectric air exists in the angle α between the chip antenna 140*b* and the ground area of the circuit board 130*b* causing the coupling effect and consequently changes the frequency of the chip antenna 140*b*.

The coupling effect occurs even when the angle between the chip antenna 140*b* and the connection base 110*b* is 0 degree because the chip antenna 140*b* is higher than the ground area of the circuit board 130*b*, and a separation distance exists between the ground area and the chip antenna 140*b*. Therefore, the frequency of the chip antenna 140*b* of the preferred embodiment can be adjusted easily.

When the angle between the chip antenna 140*b* and the connection base 110*b* is 45 degrees and the center frequency is the same as the center frequency shown in FIG. 5A, the strength of the ground area return loss is larger than if there were no ground area on the circuit board 130*b*. Further, the frequency response of the chip antenna 140*b* with a ground area is shifted when compared to an antenna without a ground area on the circuit board 130*b* when the return loss is the same.

Figure 5B:
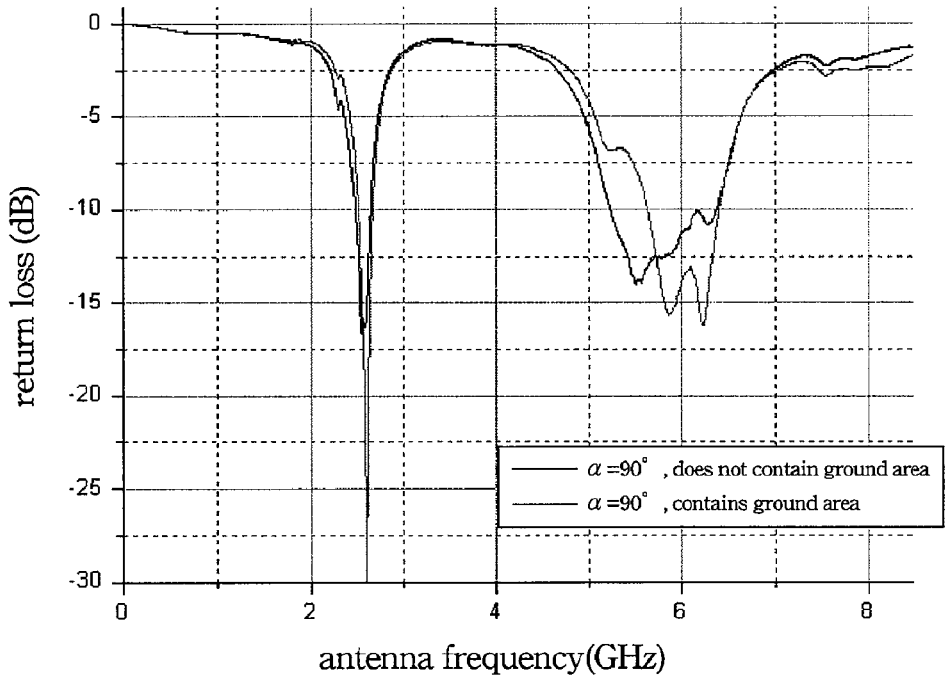
FIG. 5B is a graph of return loss versus frequency response when there is a 90 degree angle between a chip antenna and a surface of a connection base, and a circuit board contains/does not contain a ground area of the chip antenna mounting apparatus of FIG. 1B.

FIG. 5B is a return loss versus frequency response graph when there is a 90 degree angle between the chip antenna 140*b* and the surface of a connection base 110*b*, and the circuit board 130*b* contains/does not contain a ground area shown in FIG. 1B. When the angle between the chip antenna 140*b* and the connection base 110*b* is 90 degrees and the center frequency is the same as the center frequency shown in FIG. 5B, the strength of the ground area return loss is larger than if there were no ground area on the circuit board 130*b*. Further, the frequency response of the chip antenna 140*b* with a ground area is shifted when compared to an antenna without a ground area on the circuit board 130*b* when the return loss is the same. Therefore, the preferred embodiment of the present invention does not require a complicated design to adjust the frequency of the antenna chip 140*b*.

Figure 6A:
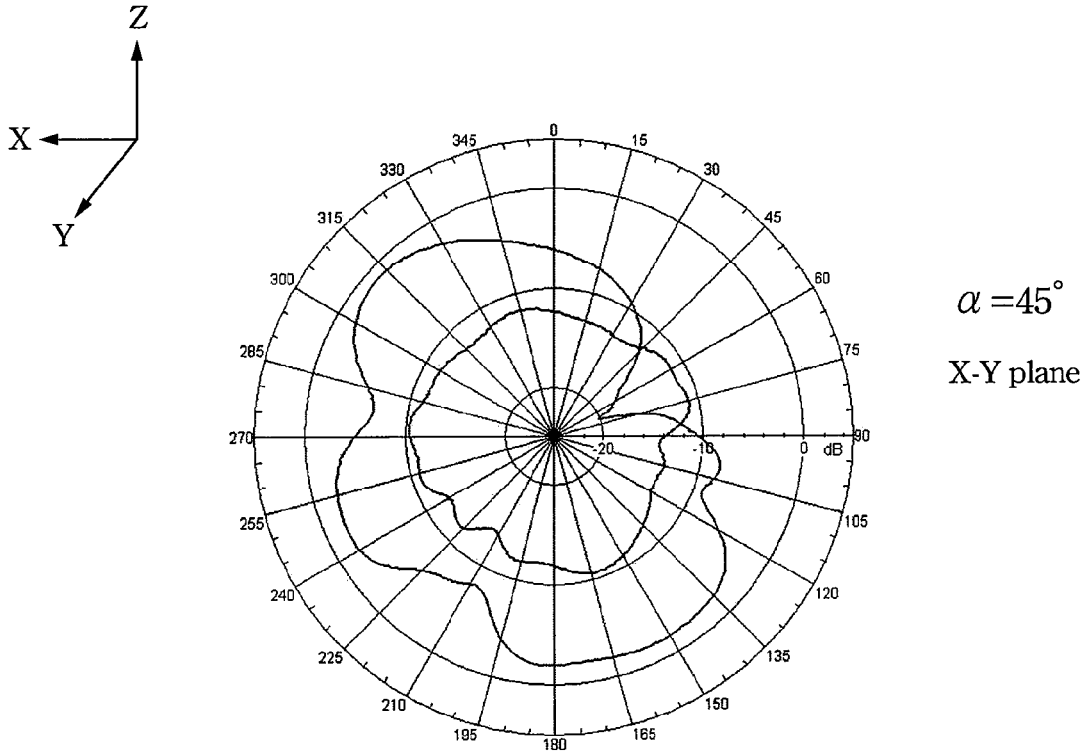
FIG. 6A~6C are the antenna pattern graphs when a chip antenna and a connection base have a 45 degree angle, a circuit board contains a ground area and the center frequency is 2.4 GHz of the chip antenna mounting apparatus of FIG. 1B.
Figure 6B:
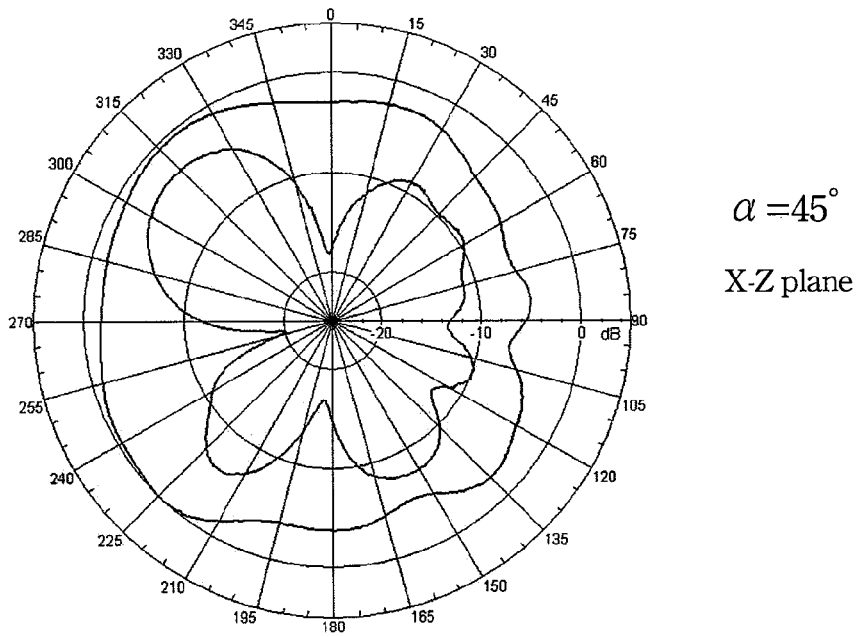
Figure 6C:
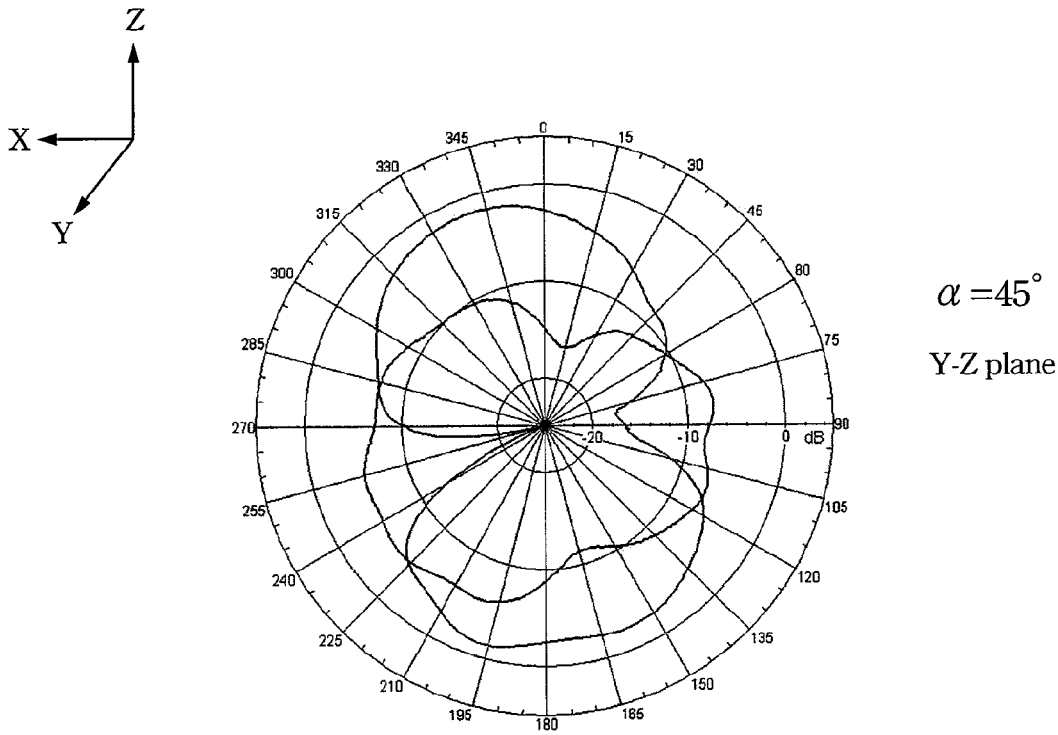

FIG. 6A, FIG. 6B and FIG. 6C are the antenna pattern graphs when the angle between the chip antenna 140*b* and the connection base 110*b* is 45 degrees ($\alpha$), the circuit board 130*b* contains a ground area and the center frequency of the chip antenna 140*b* is 2.4 GHz. FIG. 6A show the antenna pattern graph for the X-Y plane, FIG. 6B shows the antenna pattern graph for the X-Z plane and FIG. 6C shows the antenna pattern graph for the Y-Z plane of the preferred embodiment of the present invention. Comparing FIG. 6A with FIG. 2A, FIG. 6B with FIG. 2E and FIG. 2C with FIG. 2H shows the different antenna patterns formed when the same center frequency is applied and the circuit board 130*b* contains/does not contain the ground area.

Figure 7A:
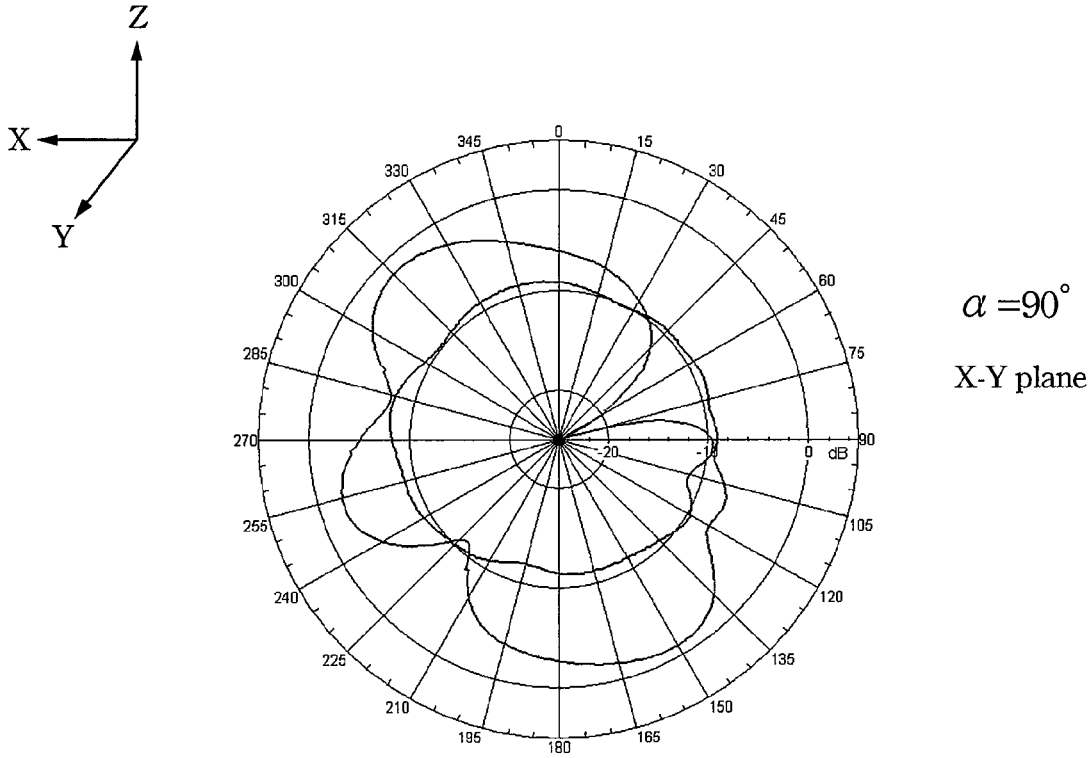
FIG. 7A~7C are the antenna pattern graphs when a chip antenna and a connection base has a 90 degree angle, a circuit board contains a ground area and a center frequency is 2.4 GHz of the chip antenna mounting apparatus of FIG. 1B.
Figure 7B:
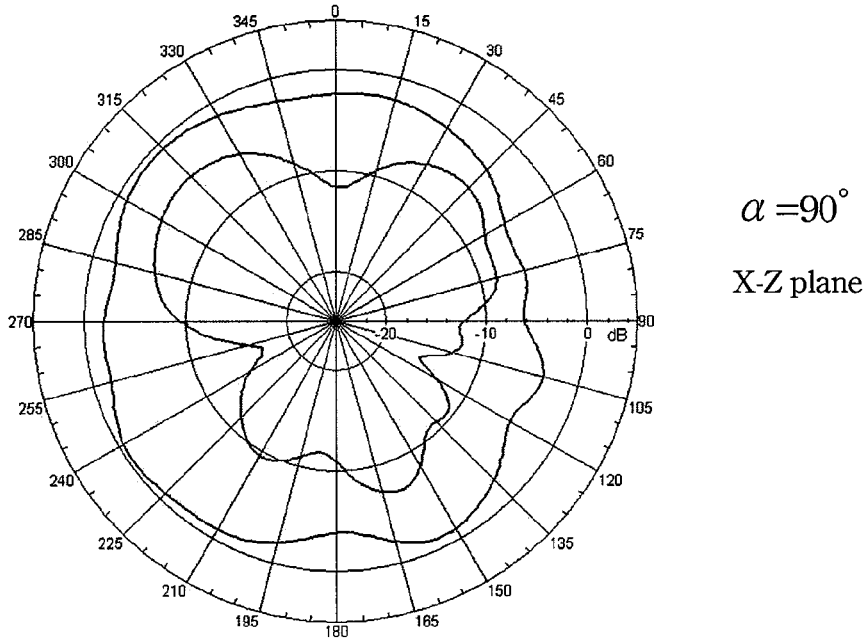
Figure 7C:
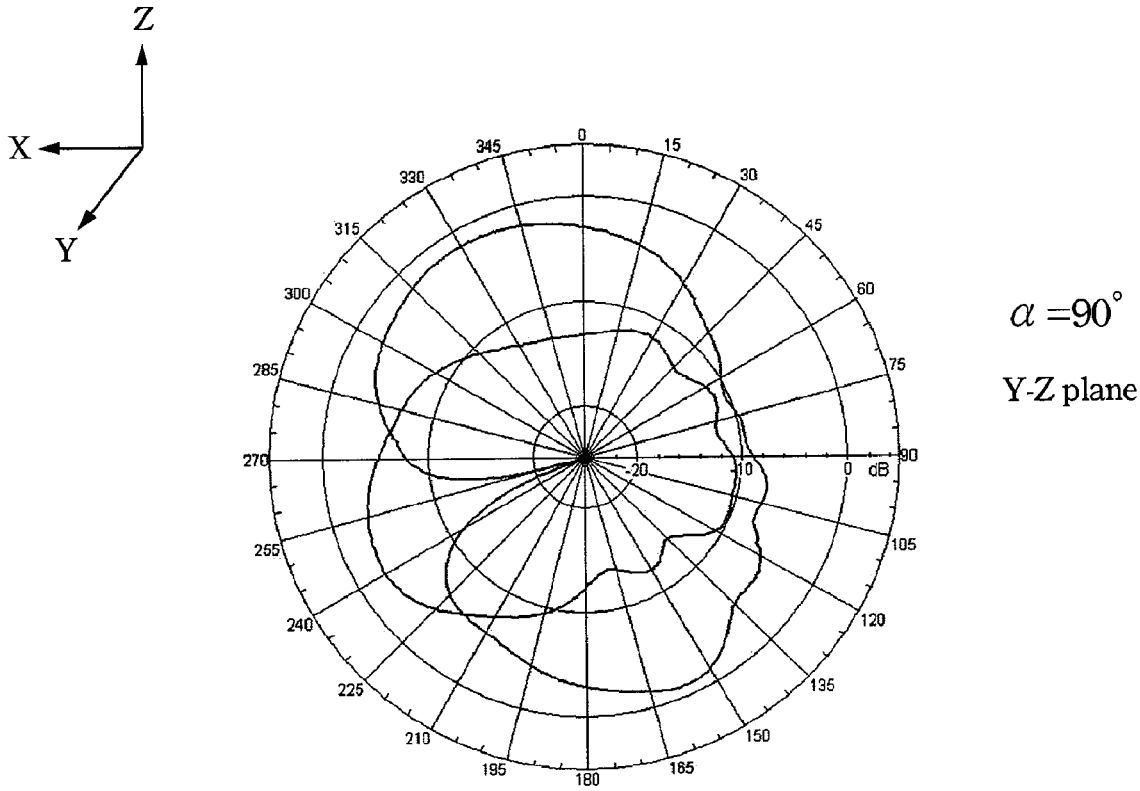

FIG. 7A, FIG. 7B and FIG. 7C are the antenna pattern graphs when the angle between the chip antenna 140*b* and the connection base 110*b* is 90 degrees ($\alpha$), the circuit board 130*b* contains a ground area and the center frequency of the chip antenna 140*b* is 2.4 GHz. FIG. 7A show the antenna pattern graph for the X-Y plane, FIG. 7B shows the antenna pattern graph for the X-Z plane and FIG. 7C shows the antenna pattern graph for the Y-Z plane of the preferred embodiment of the present invention. Comparing FIG. 7A with FIG. 3B, FIG. 7B with FIG. 3E and FIG. 7C with FIG. 3H shows the different antenna patterns formed when the same center frequency is applied and the circuit board 130*b* contains/does not contain the ground area.

The preferred embodiment of the present invention provides a chip antenna mounting apparatus, includes a connection base and at least one chip slot. The chip antenna connection apparatus provides a chip antenna to easily adjust the chip antenna angle (the angle between the chip slot and the connection base) in order to obtain the required antenna pattern, and does not require a large empty space near the chip antenna on a circuit board. Therefore, the chip antenna connection apparatus can reduce the space needed for the chip antenna and any person skilled in the art to which it pertains can design a pluggable chip slot according to the requirement to further achieve the flexibility of the chip antenna.

In the other aspect, the present invention can be seemed as a disclosure of an apparatus having a chip antenna. The apparatus having the chip antenna adjusts an angle between a chip slot and a surface of a connection base according to the required antenna pattern, and adjusts the frequency response of the chip antenna. Further, the coupling effect between the ground area and the chip antenna is strengthened when the circuit board contains the ground area. Therefore, the preferred embodiment of the present invention reduces the design complexity of the chip antenna to further achieve the smaller size for the connection of the chip antenna and the circuit board.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A chip antenna mounting apparatus, comprising:

a connection base, disposed on a circuit board, wherein the connection base has a connection wire to connect the electronic components of the circuit board; and at least one chip slot, disposed on the connection base, wherein the chip antenna is inserted into the chip slot and connected with the electronic components of the circuit board via the connection wire.

2. The chip antenna mounting apparatus of claim 1, wherein the chip slot has a connection point to connect a feed-in point of the chip antenna.

3. The chip antenna mounting apparatus of claim 1, wherein the chip slot and a surface of the connection base has an angle.

4. The chip antenna mounting apparatus of claim 3, wherein the angle corresponds to a radiation pattern of the chip antenna.

5. The chip antenna mounting apparatus of claim 3, wherein the angle corresponds to a frequency response of the chip antenna.

6. The chip antenna mounting apparatus of claim 1, wherein the chip slot is arranged to have a distance between the circuit board after the chip antenna is inserted.

7. The chip antenna mounting apparatus of claim 1, wherein the position of the chip slot is higher than the electronic components of the circuit board.

8. The chip antenna mounting apparatus of claim 1, wherein the connection base has a plurality of chip slots to provide a plurality of angles for the chip antenna.

9. The chip antenna mounting apparatus of claim 1, further comprises an adjustable knob to adjust an angle of the chip slot to a surface of the connection base.

10. The chip antenna mounting apparatus of claim 1, wherein the chip slot is a fixed chip slot or a pluggable chip slot.

11. An apparatus having a chip antenna, comprising:

a circuit board;

a chip antenna;

a connection base, disposed on the circuit board, wherein the connection base has a connection wire to connect the electronic components of the circuit board; and at least one chip slot, disposed on the connection base, wherein the chip antenna is inserted into the chip slot and connects with the electronic components of the circuit board via the connection wire.

12. The apparatus having the chip antenna of claim 11, wherein the chip slot has a connection point to connect a feed-in point of the chip antenna.

13. The apparatus having the chip antenna of claim 11, wherein the chip slot and a surface of the connection base are at an angle to each other.

14. The apparatus having the chip antenna of claim 13, wherein the angle corresponds to a radiation pattern of the chip antenna.

15. The apparatus having the chip antenna of claim 13, wherein the angle corresponds to a frequency response of the chip antenna.

16. The apparatus having the chip antenna of claim 11, wherein the chip slot is arranged to have a distance between the circuit board after the chip antenna is inserted.

17. The apparatus having the chip antenna of claim 11, wherein the position of the chip slot is arranged to higher than the electronic components of the circuit board.

18. The apparatus having the chip antenna of claim 11, wherein the connection base has a plurality of chip slots to provide a plurality of angles for the chip antenna.

19. The apparatus having the chip antenna of claim 11, further comprises an adjustable knob to adjust the angle of the chip slot to a surface of the connection base.

20. The apparatus having the chip antenna of claim 11, wherein the chip slot is an adjustable chip slot, capable of adjusting an angle between the chip slot and a surface of the connection base.

21. The apparatus having the chip antenna of claim 11, wherein the chip slot is a fixed chip slot or a pluggable chip slot.

22. The apparatus having the chip antenna of claim 11, further comprises a ground area on the circuit board corresponding to the chip antenna for coupling effect between the chip antenna and the ground area.

23. The apparatus having the chip antenna of claim 22, wherein the ground area is located near one side or the other side of the corresponding chip antenna.

24. The apparatus having the chip antenna of claim 22, wherein the ground area is made of the metal, alloy or other electrically conductive material.

* * * * *